United States Patent [19]

Zabava et al.

[11] 4,185,684

[45] Jan. 29, 1980

[54] MACHINE FOR CONTINUOUS CASTING BY DRAWING-UP

[76] Inventors: Jury G. Zabava, ulitsa Romena Rollana, 7, kv. 61; Rem N. Kogan, ulitsa Njutona, 127, kv. 21; Dzhan A. Lurie, pereulok I.Dubovogo, 2, kv. 3; Viktor G. Surkov, ulitsa Tobolskaya, 50, kv. 31; Elvira A. Bratslavskaya, ulitsa 8 Marta, 5, kv. 1, all of Kharkov; Ivan M. Barabash, 2 Begovoi proezd, 8, kv. 32, Moscow; Ilya G. Rodnyanksy, ulitsa Bibliotechnaya, 16, kv. 33, Khimki Moskovskoi oblasti; Antanas A. Maljukyavichjus, ulitsa Zhirmunu, 111, kv. 24; Egor T. Voitenko, ulitsa Parko, 22, kv. 5, both of Vilnjus; Gennady A. Anisovich, prospekt Mira, 256, kv. 54; Vladimir F. Bevza, prospekt Mira, 256, kv. 40, both of Mogilev; Vadim I. Tutov, ulitsa Knorina, 10b, kv. 51; Valentin A. Grinberg, ulitsa Gorkogo, 8, kv. 7, both of Minsk; Evgeny I. Marukovich, prospekt Jubileiny, 5, kv. 77, Mogilev; Nikolai A. Senkin, ulitsa Korzhenevskogo, 17, kv. 45, Minsk, all of U.S.S.R.

[21] Appl. No.: 889,412

[22] Filed: Mar. 23, 1978

[51] Int. Cl.[2] ..... B22D 11/126; B22D 11/128

[52] U.S. Cl. ..... 164/263; 164/421; 164/269; 164/420

[58] Field of Search ..... 164/263, 421, 269, 420

[56] References Cited

U.S. PATENT DOCUMENTS

| | | | |
|---|---|---|---|
| 1,548,618 | 8/1925 | Lane | 164/421 X |
| 2,799,065 | 7/1957 | Whitaker | 164/269 X |
| 3,302,252 | 2/1967 | Woodburn | 164/421 |

*Primary Examiner*—Robert D. Baldwin

*Attorney, Agent, or Firm*—Lackenbach, Lilling & Siegel

[57] ABSTRACT

A machine for continuous casting by drawing-up comprises at least two moulds positioned above a metal supply means, and, sequentially arranged in the drawing-up direction of the continuously cast product, a drawing-up means for pulling out said product from said moulds, a cutting-off means for cutting the continuously cast product to lengths, said means being secured directly on the cast product and performing the cutting-off operation during its stepwise upward movement together with the cast product, and a manipulator adapted to place the cut-off lengths onto a conveyer.

7 Claims, 17 Drawing Figures

MACHINE FOR CONTINUOUS CASTING BY DRAWING-UP

BACKGROUND OF THE INVENTION

1. Field of the Invention

This invention relates to continuous casting and, more particularly, to an apparatus for continuous casting of metals by drawing-up.

The present machine is preferably utilized for the production of hollow castings of cast-iron, steel and other metals and alloys.

2. Description of the Prior Art

There is known an experimental continuous casting machine (cf. "Metal Mould", by A. I. Veinick, Minsk Publishers, 1972, pp. 129–132), which comprises a housing adapted to accommodate the machine's main constructional members, namely: a lifting table mounting a metal supply means for uphill feeding of molten metal into the mould cavity. The metal supply means is basically a rigid metal moulding box packed with a refractory mixture with ingates and accommodating two water-cooled moulds for forming hollow castings. There is also provided a dummy bar adapted to start the withdrawal cycle.

The dummy bar is basically a hollow steel member with the exterior shape thereof conforming to that of the mould cavity; this dummy bar is used to initiate the casting process.

The machine is also provided with a drawing-up means adapted to pull out the continuously-cast product from the moulds. This means incorporates a pair of movable clamps and a pair of fixed clamps, a shifting arm lever, a double-profile cam, a propeller shaft, a gear box, a chain drive, a double-reduction cylindrical gear and an electric motor.

The metal supply means (moulding box) is placed on the lifting table and is then connected to the moulds. The dummy bars are introduced into the moulds and the movable clamps are brought down to be engaged with the dummy bars.

After molten metal is fed into the mould cavity through the metal supply means and reaches a predetermined level, the drawing-up means is actuated to move a hollow casting upwardly by means of the movable clamps, thereby pushing it through the fixed clamps. While the movable clamps are shifted to a lower position, the fixed clamps are locked to grip the hollow castings, thereby holding them in a fixed position. As this happens, the movable clamps are brought apart to slide over the fixed hollow castings. By adjusting the arm of the lever it is possible to vary the travelling distance covered by the hollow castings during one drawing-up cycle.

However, due to the absence of a cut-off means for cutting the hollow castings into predetermined lengths, it becomes necessary to periodically stop the drawing-up means. As a result, the molten metal solidifies in the metal supply means as well as in the mould. The operating cycle is resumed only after the metal supply means and dummy bars have been changed. The continuous operation of the machine is thus disrupted, and the process does not lend itself to complete automation. From the foregoing it follows that the production efficiency of such a process is extremely low.

Moreover, the wedge-type clamps used in the casting drawing-up means cause sagging in the hollow castings to occur during the drawing-up cycle with the resultant shrinkage cavities and crackings taking place in the continuously drawn-up casting.

SUMMARY OF THE INVENTION

An object of the present invention is to render the continuous casting process completely automatic and to produce hollow castings of different diameters from cast-iron, steel and other metals and alloys.

Still another object of the invention is to provide a machine for continuous casting by drawing-up which will ensure stable and continuous casting process, enhance the production efficiency and improve the quality of the castings being produced, as well as permit the continuous-cast product to be cut to lengths and stored automatically.

These and other objects and features of the invention are attained in a machine for continuous casting by drawing-up, comprising at least two moulds positioned above a metal supply means, and, sequentially arranged in the drawing-up direction of the continuously cast product for each mold, a power-driven means for the drawing-up of the continuously cast product to be thereafter cut to lengths, and a manipulator adapted to place the cut-off lengths on to a conveyor means. According to the invention, the casting drawing-up means incorporates a block of pinch rolls driven by means of an actuator through a kinematic link formed by an overrunning clutch and a self-braking worm pair, thereby ensuring the rotation of said pinch rolls and feeding of the continuous-cast product in one direction only. The continuous-cast article is cut to lengths by a cut-off means comprising a housing accommodating a device for clamping the casting by means of gripping blocks and a cutting tool connected with said device and rotating about the casting. This housing is mounted on guides positioned along the travelling path of the continuous-cast product, and is provided with an actuator driving said housing strictly in step with the movement of the casting. The manipulator incorporates a pair of its own clamping blocks adapted to clamp a cut-off length and mounted on a bracket rigidly fixed on a sleeve movable along a guide formed with a cam slot. This sleeve is driven by means of an actuator at a speed substantially close to the drawing-up speed of the casting, extracted from the mould the guide being mounted on a spring-loaded cross bar.

The kinematic link and actuator of the drawing-up means are interconnected through a reducer with an overrunning clutch being built into a driving gear thereof.

A rotatable cutting tool of the cut-off means is positioned on a hollow sleeve rotating about its own axis, through which freely passes the continuously drawn-up casting whose axis coincides with that of the sleeve.

Such an embodiment of a machine for continuous casting by drawing-up permits the process of producing hollow castings of different diameters of cast-iron, steel and other metals and alloys to be completely automated, and makes it stable and continuous. The continuity of the process of casting production substantially enhances the machine production efficiency and improves the quality of the products being cast.

With the provision of a plurality of moulds, the casting drawing-up means is provided with an equal number of pairs of driving rolls and guide rolls, and a reducer has the corresponding number of pairs of outputs kinematically linked to the driving rolls.

This enables the operation of withdrawing each casting to be mechanized while substantially enhancing the production efficiency.

It is possible to mount each pair of the driving rolls on its own shaft coupled through a sleeve to the reducer output shaft, said coupling sleeve being provided with a switch member adapted to disconnect the shaft from the output shaft of the reducer.

Such a connection renders the proposed machine versatile in operation, i.e. a desired plurality of moulds is used at will.

Each roll of the driving pair is provided with two taper notched rolls fitted, in a manner inclined towards each other, on a sleeve mounted on its own shaft and axially movable by means of a screw pair, whereby the casting pinched by the driving rolls is brought in alingment with the mould.

Advantageously, the taper rolls are spring-actuated by means of an adjusting spring. In this case the spring-actuated rolls are constantly pressed to the casting without idle rotation about its surface at the place of curvature.

The gripping device of the machine cut-off means comprises a pair of gripping prismatic blocks, each movably mounted on its own guides secured on the housing of the cut-off means, and a clamp member with wedge-shaped sides thereof connected to an actuator driving it onto guides so that the casting is gripped by the blocks. One of the wedge members of the clamp member is operably connected to a limit switch electrically connected to an actuator of synchronous movement as well as to an actuator for rotating the cutting tool and serving to switch on said actuators directly after the casting is gripped by the blocks and the cut-off means is fixed in position on the casting. The provision of taper rolls secured on the cut-off means makes it possible to instantaneously bring the cut-off means in contact with the casting being drawn-up and makes their movements coincident, to enable the cutting operation.

The rotatable sleeve is connected to its own actuator through a system of sequentially interconnected chain drives, the last link thereof being kinematically linked through an arm lever to the actuator rod, the arm lever interacting with limit switches and thus effecting control over the operation of the actuator during rotation of the cutting tool and acting to shut down the actuator of the gripping device, as well as the cut-off means actuator, upon full rotation of the sleeve about its axis, thereby returning the cut-off means to initial position.

This makes it possible to regulate the movement of the cut-off means and simplifies control interlocking.

Each clamping block of the manipulator is preferably made of two detachable parts, of which one part is vertically movable and the other one is stationary and spring-loaded. The movable part grips the casting on one side and the stationary part on the other side. The clamping block has at the side of the stationary part thereof a chamfered portion facing the chamfered portion provided on the stationary part along which the movable part slides over the stationary part. Both parts are in a spaced relationship determined by a pin positioned on the stationary part and received in the corresponding slots formed in one of the clamping surfaces of the movable part. Thereby, the movable part of each clamping block is freely shifted together with the casting in the vertical upward direction, thus preventing the return movement of the latter.

Such an embodiment of the manipulator clamping blocks substantially simplifies the machine construction and prevents the sagging of the casting during its drawing-up.

Said a manipulator may comprise horizontal guides mounted on a bracket inner sides, with one of the clamping blocks of said manipulator being fixedly mounted on said guides and the other one being mounted movably therealong. The movable clamping block is provided with a stop member which, in the course of the sleeve sliding over the cam slot along said guide, bears against a stop block, thus bringing to a halt the movable part of the clamping block, while the fixed part thereof continues its movement together with the movable sleeve, whereby the clamping blocks are brought apart.

In addition, the movable sleeve is provided with a pin fitted into the cam slot and kinematically linked with an actuator, thereby ensuring the shifting and turning of the cut-off length held in the clamping blocks rigidly connected to the sleeve.

Thus, the operation of bringing the clamping blocks apart is mechanized and the cut-off length held therebetween is turned through 90 deg. to be thereby placed on a conveyer.

BRIEF DESCRIPTION OF THE DRAWINGS

The above and other objects, advantages and features of the invention will now be explained by means of the following detailed description of preferred embodiments thereof, with reference to the accompanying drawings, wherein.

DETAILED DESCRIPTION OF THE INVENTION

Figure 1:
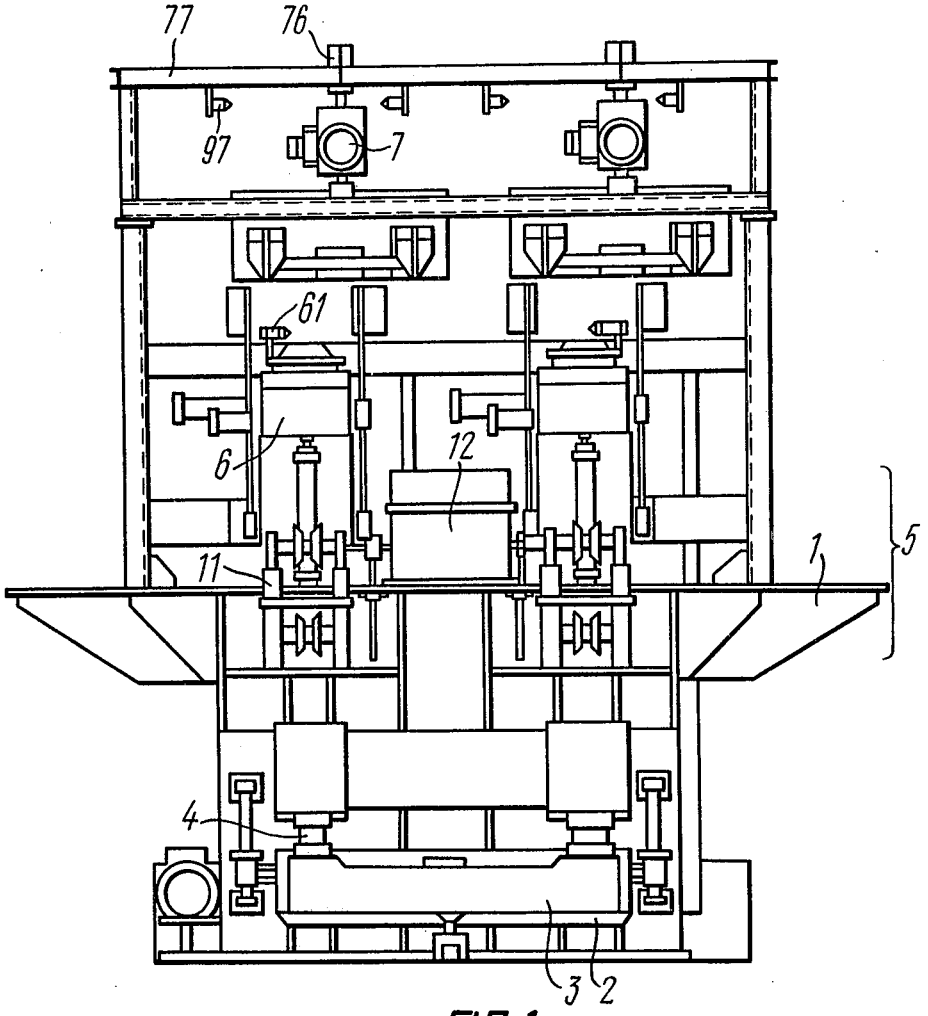
FIG. 1 is an elevational view of a machine for continuous casting by drawing-up according to the invention.
Figure 2:
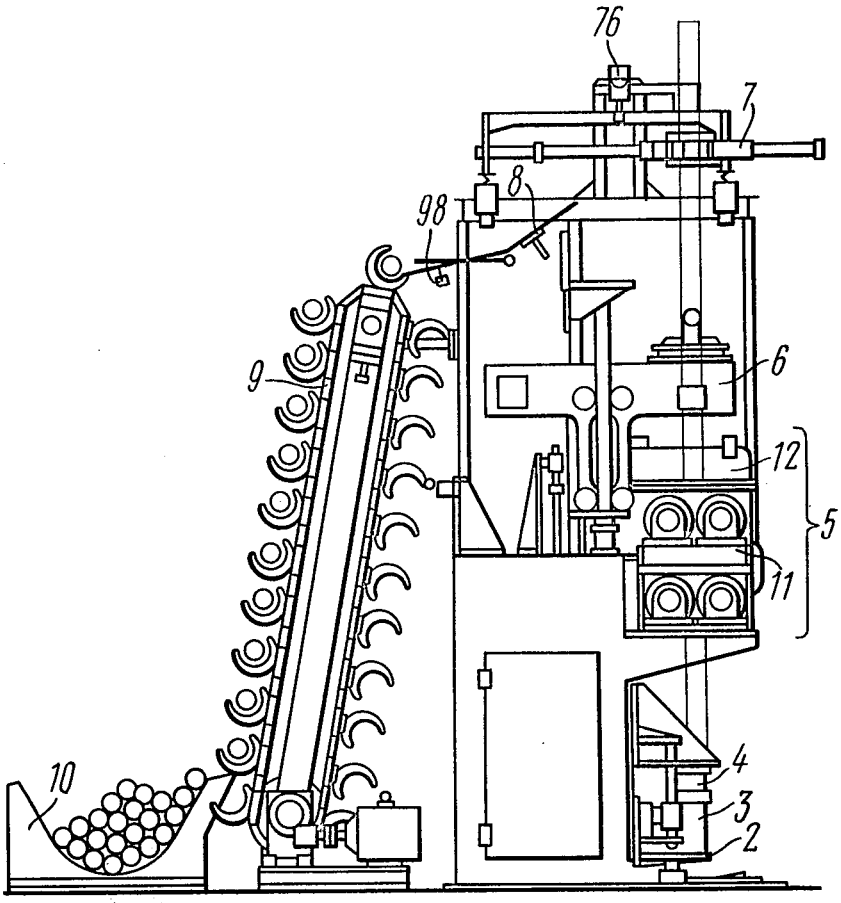
FIG. 2 is a side view of a machi ne for continuous casting apparatus according to the invention.

Referring now to the drawings, and to FIGS. 1 and 2 in particular, there is shown therein a machine for continuous casting by drawing-up which comprises a bed 1 on which there are sequentially mounted in accordance with the process flowsheet: a lifting table 2 which supports a metal supply means (or moulding box) 3; moulds 4; casting drawing-up means 5; means 6 for cutting off the continuously cast product into predetermined lengths; manipulators 7; slipways 8; a conveyor 9; and receptacle means 10. The number of cut-off means 6, manipulators 7, slipways 8, conveyors 9 and receptacles 10 should correspond to the number of moulds 4. In the preferred embodiment two moulds are provided.

Figure 3:
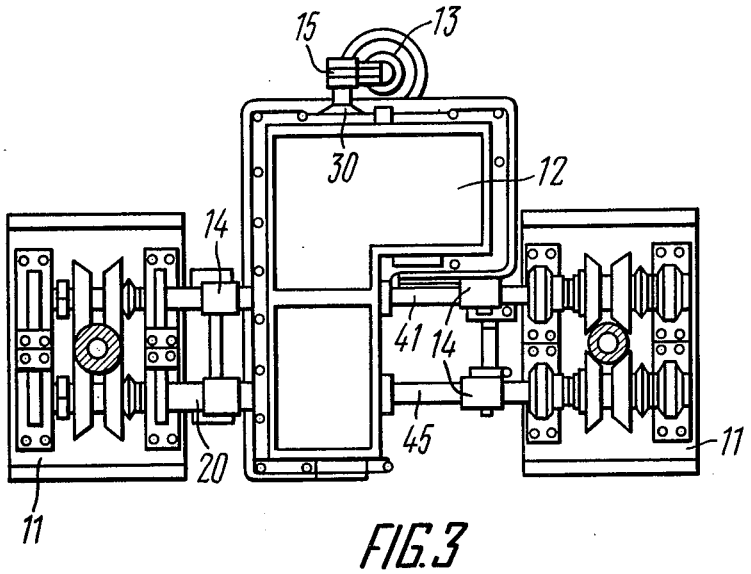
FIG. 3 is a top, plan view of a drawing-up means according to the invention.
Figure 4:
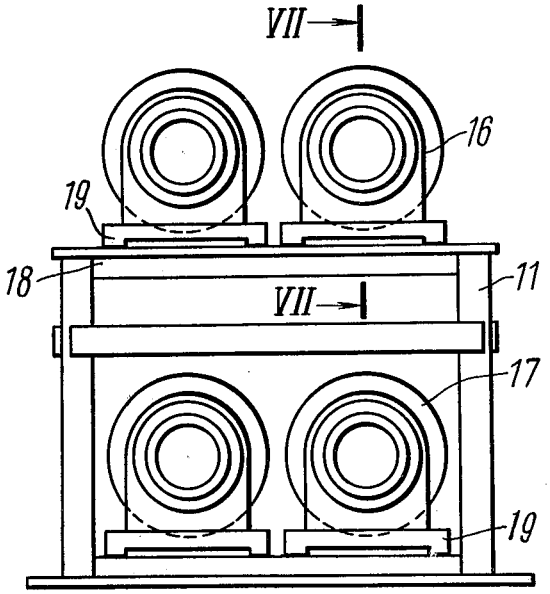
FIG. 4 is a partial side view showing a block of pinch rolls of the drawing-up means according to the invention.
Figure 6:
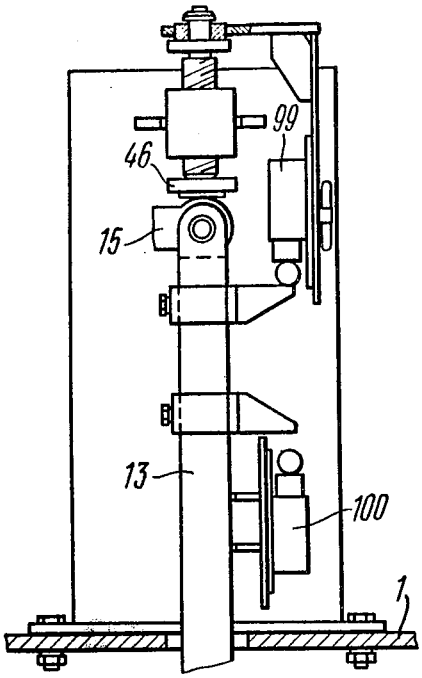
FIG. 6 is an elevational view showing a rod of the drawing-up means actuator, according to the invention.
Figure 7:
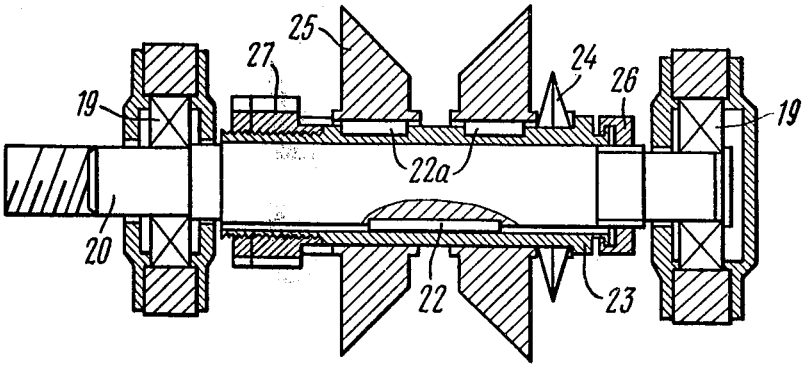
FIG. 7 is a sectional view of the driving rolls of the block of pinch rolls taken along the line VII—VII of FIG. 4, according to the invention.
Figure 8:
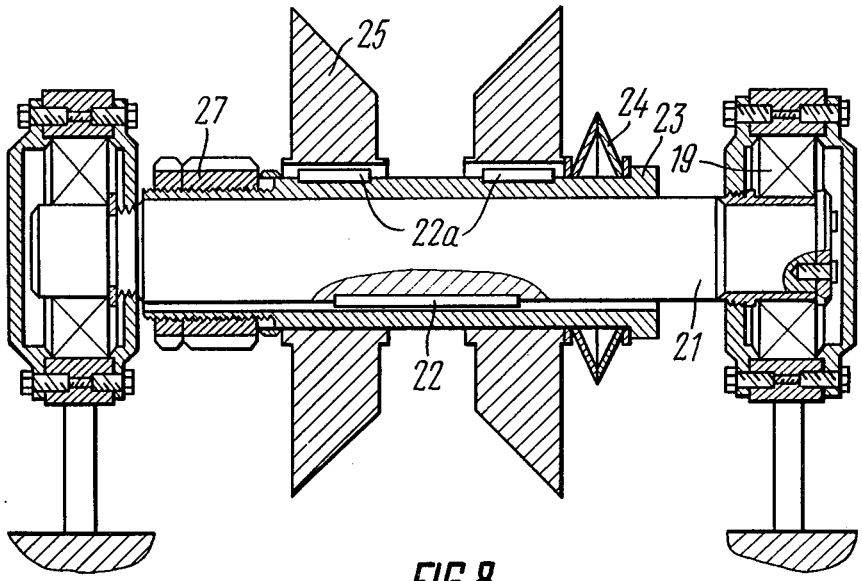
FIG. 8 is an enlarged view of the guide rolls of the block of pinch rolls, according to the invention.
Figure 9:
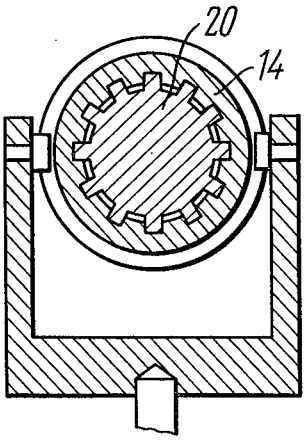
FIG. 9 is an elevational view of coupling sleeve of the drawing-up means according to the invention.

The drawing-up means 5 (see FIGS. 1 and 2) comprises the following kinematically interconnected members: a block 11 (FIGS. 1,3) of pinch rolls, a reducer 12, an actuator 13, coupling sleeves 14 (FIGS. 3,9) and a lever, such as shown at 15 in FIGS. 3 and 6. The block 11 of pinch rolls, shown in FIGS. 1,2 and 4, comprises driving rolls 16 and guide rolls 17 mounted on a frame 18 and journalled in bearings 19. Mounted on shafts 20 and 21 (FIGS. 7 and 8) of the driving and guide rolls 16 and 17 by means of keys 22 are movable sleeves 23 each having fitted thereon and loaded by means of springs 24 taper rolls 25 formed with an inner notch and engaged with the movable sleeve 23 by means of a key 22*a*. A screw 26 is intended for bringing the driving rolls 16 in alignment with the respective mould 4, and a nut 27 is intended for regulating the clamping force of the spring-loaded taper rolls 25. However, the driving rolls 16 and guide rolls 17 can be constructed otherwise than split and spring-loaded along the shaft axis. For example, they can be of solid construction of any profile and spring-loaded perpendicularly to the shaft axis.

Figure 5:
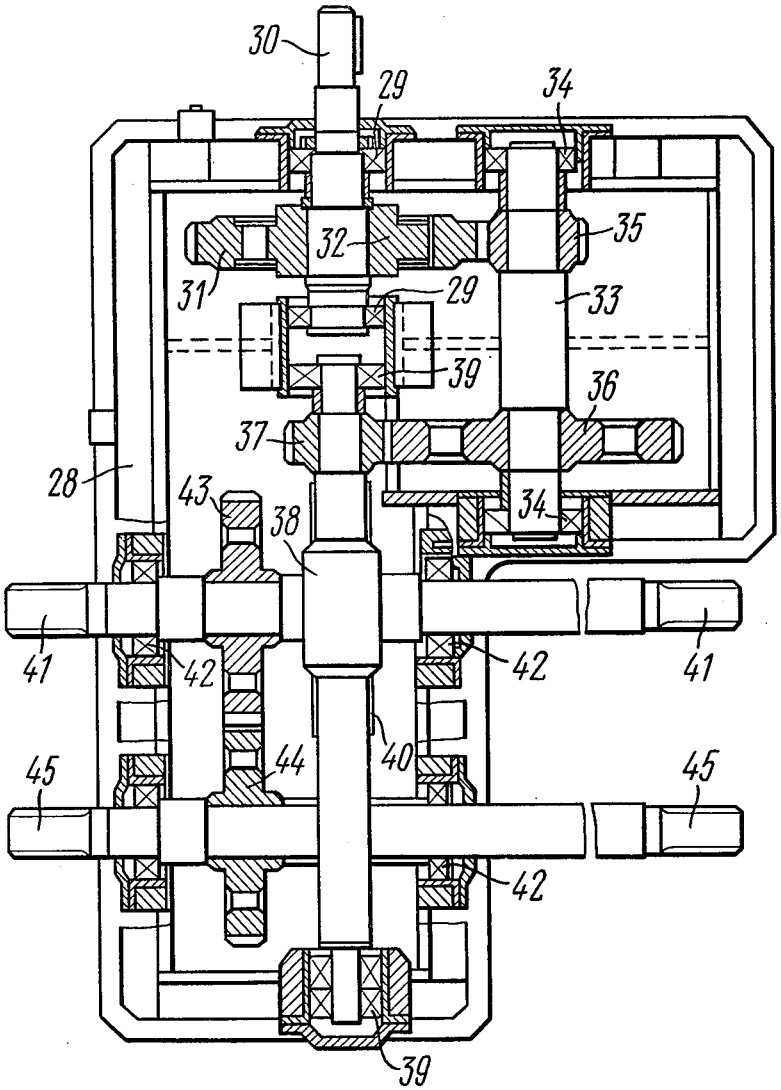
FIG. 5 is a plan view showing a reducer of the drawing-up means according to the invention.

The reducer 12 (FIGS. 1,3,5) comprises a housing such as shown at 28 in FIG. 5, wherein journalled in bearings 29 is an input power shaft 30, gears 31 having built thereinto an overrunning clutch 32, and an intermediate shaft 33 journalled in bearings 34. Mounted on the intermediate shaft 33 is a gear 35 brought into engagement with the said gear 31, and a gear 36 fitted on the shaft 33 and brought into engagement with a gear 37 rigidly mounted on a worm shaft 38 journalled in bearings 39. The worm shaft 38 is kinematically linked to a worm wheel 40 mounted on an output shaft 41 journalled in bearings 42 within the housing 28. Rigidly mounted on the output shaft 41 is a gear 43 brought into engagement with a gear 44 rigidly mounted on a second output shaft 45 journalled in bearings 42.

However, said reducer may be variously otherwise embodied such as having any self-braking member and being provided with an electric, hydraulic or any other actuator to be driven therewith. The shafts 20 (FIGS. 3, 7) of the block 11 of the pinch rolls are kinematically linked by means of the coupling sleeves 14 to the output shafts 41 and 45 (FIGS. 3, 5) of the reducer 12. Such link is effected by means of a sleeve of any construction, be it power-driven or not.

The actuator 13 is kinematically linked to the input shaft 30 (FIGS. 3,5) of the reducer 12 by means of the lever 15. The working stroke of the actuator 13 is adjusted by a stop member such as shown at 46 in FIG. 6. If the actuator is of an electric type, the working stroke thereof can be regulated either by means of eccentrics or a friction clutch, or else by means of interlocking elements.

Figure 10:
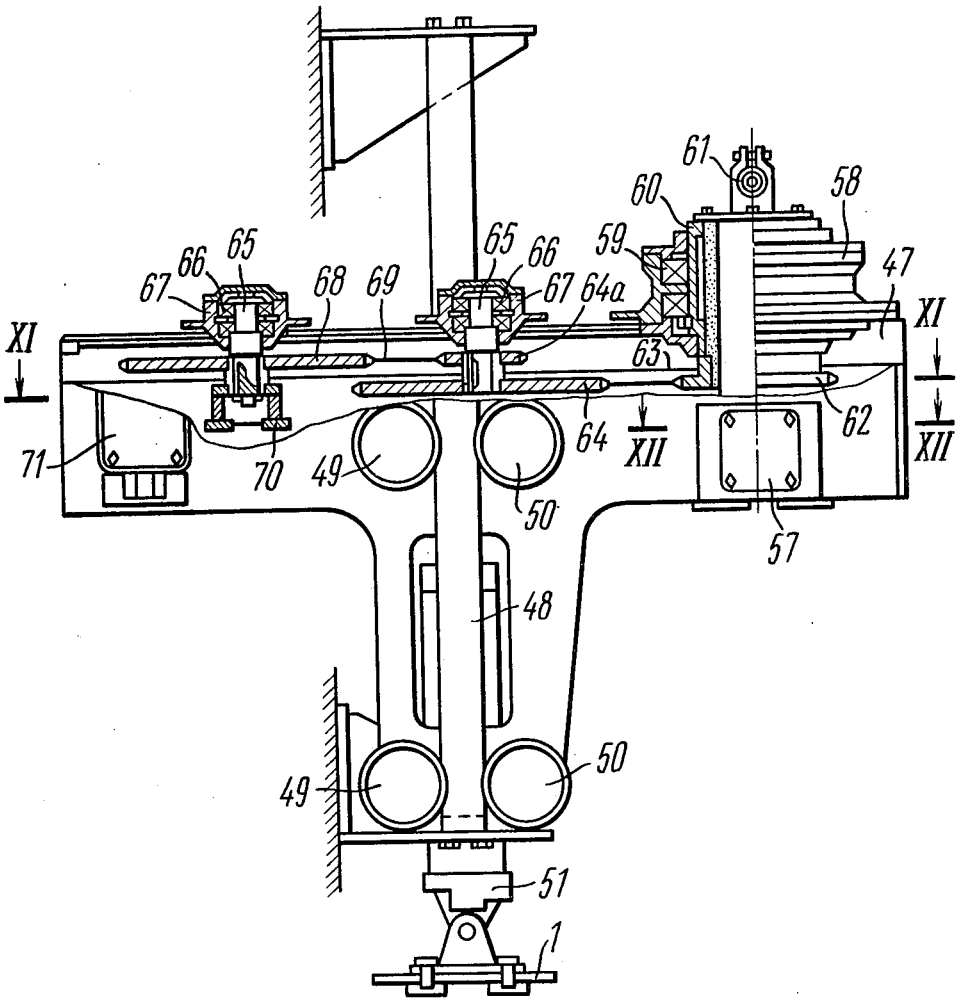
FIG. 10 is a side view of a cut-off means according to the invention.

Mounted sequentially after the drawing-up means 5 (FIGS. 1, 2) and coaxially with the blocks 11 of pinch rolls are the cut-off means 6. The cut-off means 6 comprises a housing 47, such as shown in FIG. 10, mounted on guides 48 by means of carrying taper rollers 49 and 50 (FIGS. 10, 11), and actuator 51 of synchronous movement secured on the bed 1 and kinematically linked with the housing 47 of a gripping device 52, shown in FIG. 12.

The gripping device 52 is mounted within the housing 47 and is provided with gripping blocks 53 mounted on guides 54 and actuated by means of spring 55, and a clamp 56 formed with wedge-shaped sides 56*a l and 56b* and operably connected to an actuator 57.

Mounted within a housing 58 (FIG. 10) and journalled in bearings 59 is a rotatable sleeve 60 being arranged in strict axial alignement with the mould 4 (FIGS. 1,2), as well as with the block 11 of pinch rolls. The rotatable sleeve 60 (FIG. 10) supports a cutting tool 61 which is rotated by means of a sprocket 62 and a chain drive 63, with an intermediate chain of sprockets 64 and 64*a* being mounted on an axle 65 in bearings 66 within a housing 67, through a chain drive 69 and a sprocket 68. The sprocket 68 is connected to a lever 70 (FIG. 11) which, in turn, is connected to a drive 71 for rotating the cutting tool 61. The working stroke of the drive 71 for rotating the cutting tool 61 is regulated by means of a stop member 72 fitted on the housing 47.

The terminal position of the cutting tool 61 is controlled by means of limit switches 73 and 74. The clamping of continuously cast hollow products is controlled during their movement by means of a limit switch 75.

It is worthwhile to note that the actuators 71 and 57 of the cut-off means 6 can be of any conventional type, such as mechanical, electric, pneumatic or hydraulic ones.

Figure 13:
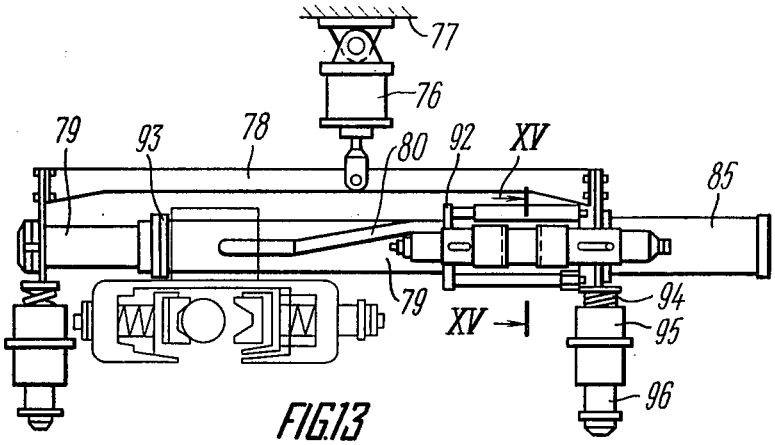
FIG. 13 is a side view of a manipulator according to the invention.
Figure 14:
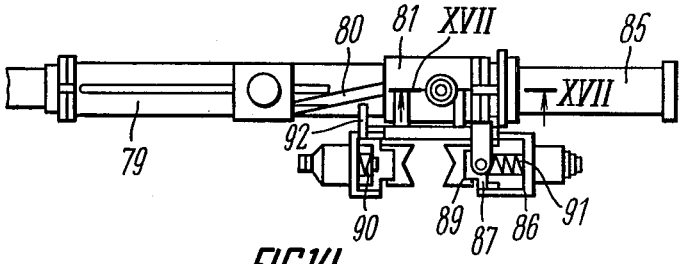
FIG. 14 is a top, plan view of a manipulator according to the invention.
Figure 15:
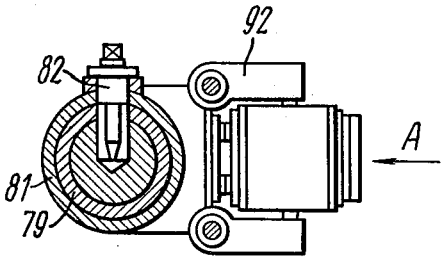
FIG. 15 is a sectional view of the gripping device, taken along the line XV—XV of FIG. 13, of the manipulator according to the invention.
Figure 16:
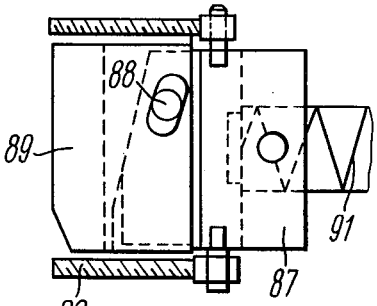
FIG. 16 is a view taken in the direction of arrow A at the manipulator gripping device (see FIG. 15), according to the invention.
Figure 17:
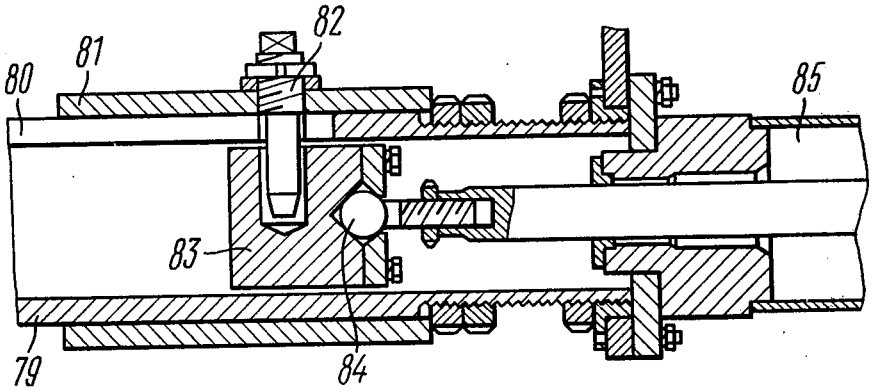
FIG. 17 is a sectional view showing the connection of the manipulator movable sleeve with the manipulator actuator, taken along the line XVII—XVII of FIG. 14, according to the invention.

Arranged on the bed 1 sequentially after the cut-off means 6 (FIGS. 1 and 2) are the manipulators 7 each comprising an actuator 76 (FIGS. 1, 2 and 13), the body of which is pivotally mounted on a frame 77 (FIG. 1) and pivotally connected to a cross bar 78 having attached thereto a guide 79 (FIGS. 13 and 15) formed with a cam slot 80. Mounted on the guide 79 is a movable sleeve 81 (FIGS. 15 and 17) kinematically linked to the cam slot 80 through a pin 82, the pin 82 connecting the sleeve 81 through a sliding block 83 and a pin 84 with an actuator 85 (FIGS. 13 and 17). Fixedly attached to the movable sleeve 81 is a bracket 86 such as shown in FIG. 14, wherein are mounted spring-loaded blocks such as shown at 87 in FIG. 16. Fixedly attached to the blocks 87 by means of a pin 88 are prismatic blocks 89. Springs 90 and 91, such as shown in FIG. 14, press the prismatic blocks 89 against the body of the hollow product being continuously cast. One of the blocks 87 has a movable stop 92 fixed thereto. The guide 79 is provided with a stop block 93. The manipulator 7 is mounted on a spring 94 (FIG. 13) accommodated in cylinders 95 on shafts 96. The operation of cutting the continuously cast hollow product to predetermined lengths is controlled by a photocell means 97 shown in FIG. 1. The conveyor means 9 (FIG. 2) are actuated on command from limit switches 98 (FIG. 2) mounted on the slipway 8. The actuator 13 is brought into intermittent operation on command from end switches 99 and 100, showin in FIG. 6.

The manipulator 7 can be provided with electric, hydraulic or other types of actuators, being capable of shifting the cast product in any plane without tilting it, whereas the gripping device of the hollow cast products has an individual actuator.

The multi-strand machine for continuous casting by drawing-up according to the invention operates as follows.

After preparing facing sand and performing a metal supply means, the metal supply means is placed on the lifting table 2 and is then brought in strict axial alignment with each mould 4. The lifting table 2 is thereafter raised, whereby the metal supply means 3 is pressed against the moulds 4. Thereupon, the moulds 4 undergo heating together with the metal supply means 3. The manipulator 7 is brought to its extreme position by means of the actuator 85.

Introduced through the cut-off means 6 and through the block 11 of the withdrawal pinch rolls is a dummy bar which is, for example, a pipe of the same diameter as the continuously cast tubular product, extended until it bears against a stop (not shown) fitted in the mould 4. The axial alingment of the dummy bar with the mould 4 and with the block 11 of the withdrawal pinch rolls is then checked. If necessary, axial adjustment of the dummy bar relative to the driving rolls 16 and guide rolls 17, as well as relative to the mould 4, is effected by shifting the sleeve 23 (FIG. 7) along the shaft 20 by means of turning the nut 26. The nut 27 is tightened to press together the taper rolls 25 and disc springs 24, whereby the dummy bar is forced into contact with the notch formed on the tapered side of the rolls 25.

The manipulator 7 is brought back to the initial position. The stop limit 46 (FIG. 6) is used to determine the working stroke of the actuator 13 (FIG. 3).

Water is then supplied to the moulds 4 and air is delivered to air distributors of the actuators. Molten metal is then fed and poured into the metal supply means 3. After the moulds 4 are filled with the molten metal, the cooling system of the moulds 4 is switched on. A few seconds later, the actuator 13 is operated to transmit stepwise rotation through the lever 15 (FIG. 3) to the input power shaft 30 (FIG. 5) of the reducer 12, said shaft being mounted within the housing 28 and carrying the overrunning clutch 32 rigidly secured thereto. The clutch 32 is fitted with a rim, it being the gear 31 meshed with the gear 35 fixedly mounted on the intermediate shaft 33. Rigidly fixed on the intermediate shaft 33 is the gear 36 which transmits stepwise rotation to the gear 37 fitted on the worm shaft 38 journalled in bearings 39.

The worm shaft 38 transmits stepwise rotation to the worm wheel 40, and to the output shaft 41. In turn, the output shaft 41 transmits stepwise rotation through the fixedly mounted thereon gear 43 to the gear 44 which, being rigidly connected to the output shaft 45, imparts stepwise motion to the output shaft 45.

The output shafts 41 and 45 (FIG. 3) are coupled through the coupling sleeves 14 to the shafts 20 (FIG. 7), each of which is connected through a respective key 22 to the movable sleeves 23, the sleeves 23 transmitting rotation through the respective keys 22*a* to the respective taper rolls 25, with the dummy bar being clamped therebetween.

Thus, with the reciprocal movement of the actuator 13 (FIG. 3 and 6), the dummy bar is pulsatingly shifted upwards in accordance with a predetermined cycle regulated by means of the adjustable stop 46 adapted to limit the working stroke of the actuator 13.

In the course of its stepwise upward movement, the continuously cast tubular product freely passes through the prismatic blocks 89 (FIGS. 14 and 16) of the manipulator 7 (FIG. 1 and 2), this being possible due to the provision of a bevelled section on the back wall of the prismatic block 89, and of the bevelled section on the front face of the spring-loaded block 87. Owing to the bevelled sections, the tubular casting shifts the prismatic block 89 upwardly while moving in the upward direction, whereby a gap is established between the tubular casting and the prismatic block 89. Upon reaching a prescribed length limit, the tubular casting actuates the photocell 97 (FIG. 1) that feeds a switch-on command to the actuator 57 (FIGS. 11 and 13) which is operated to pull out the clamp 56 with the wedge-shaped sides 56*a* and 56*b*.

Figure 11:
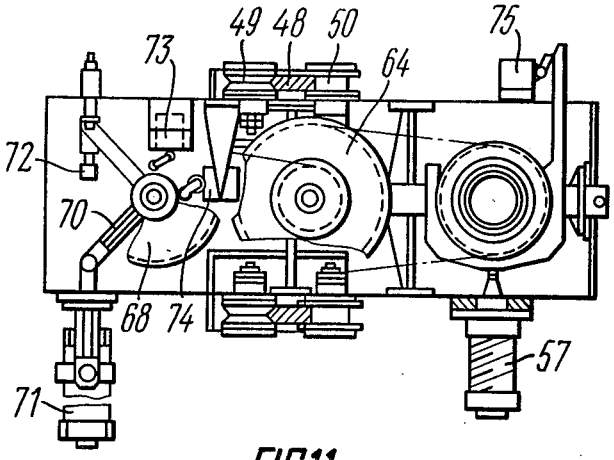
FIG. 11 is a top, plan view of the cut-off means, taken along the line XI—XI of FIG. 10, according to the invention.
Figure 12:
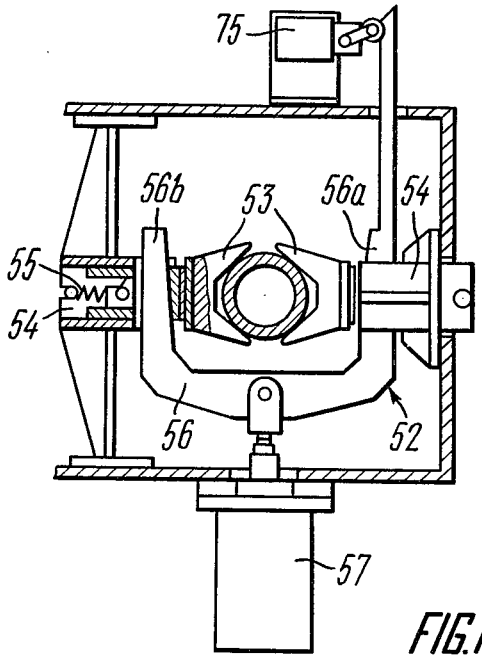
FIG. 12 is a sectional view of a gripping device of the cut-off means, taken along the line XII—XII of FIG. 10, according to the invention.

The clamp 56 pushes forward the gripping blocks 53 to thereby grip the tubular casting. The limit switch 75 is then energized to operate the actuator 51 of synchronous movement (FIG. 10) which unloads the main actuator 13 (FIG. 3) used to enable stepwise upward movement of the cut-off means 6. The cut-off means 6 (FIGS. 1, 2 and 10) starts moving upwardly in a stepwise manner together with the tubular product being cast. Simultaneously, the arc of the cutting tool 61 is started, whereupon the actuator 71 (FIGS. 10 and 11) becomes operable to slowly shift the lever 70 until it is thrust agaist the adjustable stop 73, the lever 70 being connected to the sprocket 68 fitted on the axle 65. By this means the sprocket 68 is rotated and this motion is transmitted through the chain drive 69 to the sprockets 64 and 64*a*, the sprockets being connected through the chain drive 63 to the sprocket 62 mounted on the rotatable sleeve 60. The cutting tool 61 is secured on the sleeve 60. The cutting operation starts simultaneously with the stepwise movement of the tubular product being cast. After the lever 70 (FIG. 11) is thrust up against the stop 72, and the cutting tool 61 (FIG. 10) is turned approximately through 365 deg., thereby completing the cutting-off operation, the limit switch 74 (FIG. 11) is tripped to cut out the actuator 57, as well as the actuator 51 (FIG. 10) and the actuator 71 (FIG. 11). With the actuator 57 (FIG. 12) being cut out, the clamp 56 is returned to the initial position, and the springs 55 urge the gripping blocks 53 apart.

The cut-off means 6 (FIGS. 1, 2 and 10) start moving downwards back to their initial position, whereas the manipulators 7 (FIGS. 1 and 2) are urged upwards abruptly by means of the actuators 76 (FIGS. 1, 2 and 13) being switching-on and the uncoiling springs 94 (FIG. 13) seated in the cylinders 95 on the shafts 96. The cut-off tubular length is slightly displaced from the cutting place. The spring-loaded blocks 87 (FIGS. 14 and 16) and the prismatic blocks 89, locked in position by means of the pin 88, grip the tubular casting due to the bevelled section, thus preventing it from slipping.

After the manipulator 7 (FIGS. 1 and 2) is raised, the actuator 85 (FIGS. 13 and 14) is operated to impart motion to the tubular casting through the pin 84, (FIG. 17) sliding block 83 and pin 82 which connects the movable sleeve 81 carrying the bracket 86 (FIG. 14) to the cam slot 80.

The movable sleeve 81 (FIGS. 15 and 17) slides over the cam slot 80, turning the tubular casting through 90 deg. Thrusting against the stop limit 93 (FIG. 13), the adjustable stop 92 (FIG. 16) acts to unclamp the spring-loaded blocks 87 (FIGS. 14 and 16) as well as the prismatic blocks 89 fitted on the blocks 87 by means of the pins 88. As a result, the tubular casting freely drops on the slipway 8 (FIG. 2).

Rolling over the slipway onto a conveyer, the tubular casting presses on the limit switch 98 (FIG. 2) which actuates the conveyor 9 to turn through one step, thereby making room for the succeeding tubular casting and simultaneously dropping off the preceeding one into the receptacle 10.

The machine according to the invention for continuous casting by drawing-up permits the production of continuously cast hollow products of iron, steel and other alloys of various cross section.

The present invention provides several distinct advantages, as follows:

The inventions assures, by virtue of the invention, high mechanical properties of the products being continuously cast, and completely excludes all kinds of casting rejects. Further, manual operations connected with cutting the continuous-cast product to lengths and stowing thereof are eliminated.

Furthermore, the multi-strand machine for continuous casting by drawing-up according to the invention ensures stable continuous casting process whereby the continuous-cast products are produced automatically.

Finally, the machine for continuous casting by drawing-up according to the invention ensures high production efficiency, with the finished product output amounting to 95–98 percent. Working conditions are likewise substantially improved by virtue of eliminating labor consuming operations required for preparing and setting the machine after each casting cycle.

While the invention has been illustrated and described as embodied in the machine for continuous casting by drawing-up for making tubular products, it is not limited to the details shown, since with the apparatus of the invention it is possible to produce hollow products of any length and of any desirable cross section.

What is claimed is:

1. A machine for continuous casting by drawing-up comprising:

a bed;

a lifting table mounted on said bed for upward and downward movement;

a metal supply means mounted on said table;

at least two molds fixedly mounted on said bed and arranged above said metal supply means;

drawing-up means for pulling out the continuous-cast product from said molds, comprising: a block of pinch rolls mounted on said bed to pinch said hollow continuous-cast product, thereby moving the product upwardly in a vertical direction only; a reducer secured on said bed and mechanically linked to said block of pinch rolls, enabling said rolls to rotate, and thereby drawing-up said continuous-cast product in one direction only; and an actuator secured on said bed and mechanically linked to said reducer;

means for cutting said continuous-cast product to lengths comprising: guides fixedly mounted on said bed; a housing mounted on said guides for reciprocal movement therealong; an actuator of synchronous movement secured on said bed and mechanically linked to said housing to impart reciprocal motion to the housing slidingly along said guides; a device for gripping said hollow continuous-cast product including guides mounted within said housing, a pair of gripping blocks by means of which said cut-off means is pressed against said hollow continuous-cast product, said blocks being movably mounted on said guides, an actuator, and a clamp member with wedge-shaped sides connected to and actuated by said actuator to be brought into interaction with said gripping blocks thus operated to grip said hollow product being cast; a hollow sleeve mounted within said housing and rotatable about its axis, said sleeve being arranged coaxially with said hollow continuous-cast product passing therethrough and with said mold; a drive mechanically linked to said hollow sleeve and imparting rotation to the sleeve about its axis; and a cutting tool mounted on said sleeve to cut said hollow continuous-cast products to lengths, the products moving upwardly and said sleeve rotating about an axis in alignment with the axis of said hollow product being cast; and a manipulator mounted on said bed above said cut-off means and comprising: a drive means secured to the upper part of said bed; a cross bar connected to said drive means by which it is moved vertically upward and downward; a guide mounted on said cross bar, formed with a cam slot and provided with a stop member; spring-loaded support members fixedly mounted on said bed and supporting said guide and cross bar; a drive means mounted on said guide; a movable sleeve mounted on said guide and mechanically connected to said cam slot and drive means enabling reciprocal movement over said cam slot along said guide as far as said stop member; a bracket mounted on said movable sleeve; and spring-loaded blocks fixedly mounted on said bracket to clamp said cut-off hollow continuously cast product.

2. A machine as claimed in claim 1, wherein said drawing-up means for a hollow casting comprises a reducer comprising:

a housing secured on said bed; an input power shaft journalled in bearings within said housing and mechanically connected to said actuator of said drawing-up means;

a gear rigidly mounted on said power shaft and rotating therewith;

an overrunning clutch built into said gear and rotating therewith;

an intermediate shaft journalled in bearings within said housing;

a pair of gears rigidly mounted on said intermediate shaft, a first gear being meshed with said gear of said overrunning clutch and being set in motion therewith;

a worm pair including a worm shaft mounted in bearings within said housing and a worm wheel geared to said worm shaft;

a gear rigidly fixed on said worm shaft and brought into engagement with a second gear fitted on said intermediate shaft thereby being set in rotation;

a first output shaft mounted in bearings within said housing and having rigidly fixed thereon, and rotating therewith, said worm wheel;

a gear fitted on said first output shaft, a second output shaft mounted in bearings within said housing; a gear rigidly fixed on said second output shaft, brought into engagement with said gear mounted on said first output shaft and set in rotation together with said said second output shaft; and a block of withdrawal pinch rolls comprising: a supporting frame secured on said bed; at least two pairs of driving rolls mounted on said supporting frame to pinch the continuous-cast hollow product; at least two individual shafts, one for each pair of said driving rolls, each of said shafts being mounted in bearings on said frame; at least two sleeves each having fitted thereon a respective pair of said driving rolls, said sleeves being mounted on respective shafts together with said driving rolls; a coupling sleeve to couple said output shaft of said reducer to a respective individual shaft of a pair of driving rolls, said sleeve being provided with a switch element to connect to and disconnect its individual shaft from said output shaft; and guide rolls mounted on said frame to bring said hollow continuous-cast product in alignment with said mold and with said driving rolls.

3. A machine as claimed in claim 2, wherein each driving roll and each said guide roll is provided with a pair of spring-loaded taper rolls, with the side thereof facing said hollow continuous-cast product being notched.

4. A machine as claimed in claim 1, wherein said gripping blocks of said cut-off means are prismatic and provided with shanks fitted with through slots receiving said wedge-type sides of said clamp, thereby enabling said gripping blocks to slide along said guides and to be urged against the product being cast, thus attaching said cut-off means thereto for one cutting cycle.

5. A machine as claimed in claim 1, wherein each clamping block of said manipulator comprises:

a first part of said clamping block mounted in said bracket for movement by the action of a spring in a direction perpendicular to that of the movement of said cut-off hollow length, one side of said part being beveled;

a second part of said clamping block embracing the first part and being bevelled on a side pressed against said bevelled side of the first said part, thus sliding thereover in the travelling direction of said cut-off hollow length, being pressed there-against with the side opposite to the bevelled one; and at least one stop pin rigidly fixed on said first part and received in a slot formed in one of the clamping sides of said second part, said pin being movable upwardly and being locked in position during downward movement.

6. A machine as claimed in claim 5, wherein said manipulator incorporates:

horizontal guides mounted on an inner side of said bracket, one of said blocks being fixedly mounted on said guides, the other one being mounted for free movement therealong, said movable block being provided with a stop member which, in the course of sliding of said sleeve over said cam slot along said guide, bears against said stop block, thus bringing to a halt said movable part of said clamping block, while the fixed part thereof continues its movement together with said movable sleeve, thereby bringing apart said clamping blocks.

7. A machine as claimed in claim 1, wherein said movable sleeve of said manipulator is fitted with a pin adapted, to mechanically connect said sleeve to said actuator, received in said cam slot in a manner permitting, during movement of said sleeve over said slot, said hollow cut-off length to be shifted and turned while being held in the grip of said clamping blocks connected to said sleeve.

* * * * *